US011702717B2

(12) United States Patent
Santacreu et al.

(10) Patent No.: US 11,702,717 B2
(45) Date of Patent: Jul. 18, 2023

(54) MARTENSITIC STAINLESS STEEL AND METHOD FOR PRODUCING THE SAME

(71) Applicant: APERAM, Luxembourg (LU)

(72) Inventors: Pierre-Olivier Santacreu, Isbergues (FR); Coralie Parrens, Bethune (FR); Jean-Benoît Moreau, Fille (FR)

(73) Assignee: APERAM, Luxembourg (LU)

( * ) Notice: Subject to any disclaimer, the term of this patent is extended or adjusted under 35 U.S.C. 154(b) by 20 days.

(21) Appl. No.: 16/761,158

(22) PCT Filed: Nov. 3, 2017

(86) PCT No.: PCT/IB2017/056865
§ 371 (c)(1),
(2) Date: May 1, 2020

(87) PCT Pub. No.: WO2019/086934
PCT Pub. Date: May 9, 2019

(65) Prior Publication Data

US 2020/0270718 A1 Aug. 27, 2020

(51) Int. Cl.

| | |
|---|---|
| ***C21D 9/46*** | (2006.01) |
| ***C21D 8/02*** | (2006.01) |
| ***C21D 6/00*** | (2006.01) |
| ***C21D 1/42*** | (2006.01) |
| ***C22C 38/54*** | (2006.01) |
| ***C22C 38/48*** | (2006.01) |
| ***C22C 38/44*** | (2006.01) |
| ***C22C 38/42*** | (2006.01) |
| ***C22C 38/04*** | (2006.01) |
| ***C22C 38/00*** | (2006.01) |

(52) U.S. Cl.
CPC ..... *C21D 9/46* (2013.01); *C21D 1/42* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/04* (2013.01); *C22C 38/42* (2013.01); *C22C 38/44* (2013.01); *C22C 38/48* (2013.01); *C22C 38/54* (2013.01); *C21D 2211/004* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 4,477,280 | A | 10/1984 | Shiga et al. | |
| 5,624,504 | A | 4/1997 | Miyakusu et al. | |
| 2019/0127829 | A1 * | 5/2019 | Santacreu | C22C 38/42 |

FOREIGN PATENT DOCUMENTS

| | | | | | |
|---|---|---|---|---|---|
| CN | 102260826 | A | | 11/2011 | |
| EP | 0 083 254 | | | 7/1983 | |
| EP | 1 199 374 | | | 4/2002 | |
| EP | 3 321 389 | A1 | | 5/2018 | |
| JP | 2004-052060 | | | 2/2004 | |
| JP | 2004052060 | A | * | 2/2004 | |
| JP | 2004-099964 | A | | 4/2004 | |
| JP | 2007-070654 | A | | 3/2007 | |
| JP | 2019-518609 | A | | 7/2019 | |
| WO | WO-2017010036 | A1 | * | 1/2017 | C21D 6/002 |
| WO | WO-2017182896 | A1 | * | 10/2017 | C21D 1/673 |

OTHER PUBLICATIONS

International Search Report, PCT/IB2017/056865, dated Jan. 22, 2018.
Anonymous: "1B (2) Bake-hardenable Steel Sheets", Jan. 1, 2003 (Jan. 1, 2003), XP055440701, Retrieved from the Internet: URL:http://www.jfe-21st-cf.or.jp/chapter 1 /lb 2.html—[retrieved on Jan. 15, 2018] the whole document.
Kecman, D., "Bending Collapse of Rectangular and Square Section Tubes," Int. J. Mech. Sci., vol. 25, No. 9-10, pp. 623-636, 1983.
Wierzbicki, T. et al., "Stress Profiles in Thin-Walled Prismatic Columns Subjected to Crush Loading—II. Bending," Computers & Structures, vol. 51, No. 6, pp. 625-641, 1994.

* cited by examiner

*Primary Examiner* — Jenny R Wu
(74) *Attorney, Agent, or Firm* — Nixon & Vanderhye

(57) ABSTRACT

The disclosed martensitic stainless steel is defined in its composition is by specified ranges of weight percentages of C; Mn; Si; ≤Mn+Si; ≤S; 10,000×Mn×S; P; Cr, with $[Cr-10.3-80*(C+N)^2]\leq(Mn+Ni)$; Ni; Mo; Mo+2W; Cu; Ti; V; Zr; Al; O; Ta; Nb; (Nb+Ta)/(C+N); Nb; N; Co; Cu+Co; Cu+Co+Ni; B; rare earths+Y; Ca; the remainder being iron and impurities resulting from processing. Its microstructure includes at least 75% martensite, at most 20% ferrite and at most 0.5% carbides, the size of the ferrite grains being between 4 and 80 μm, preferably between 5 and 40 μm. Also disclosed is a method of manufacturing such steel.

26 Claims, No Drawings

MARTENSITIC STAINLESS STEEL AND METHOD FOR PRODUCING THE SAME

BACKGROUND OF THE INVENTION

Field of the Invention

The present invention relates to martensitic stainless steel and its manufacturing process.

This steel is more particularly, but not exclusively, intended for use in the automobile industry, so as to constitute parts such as bodywork elements that are intended to deform upon being subject to an impact by absorbing a maximum amount of energy.

Description of the Related Art

To constitute vehicle body elements, we may use martensitic stainless steels that are shaped by hot drawing from sheet metal. They have the advantage of offering a very high mechanical resistance Rm, and thus make it possible to lighten the bodywork, while offering equal performance compared with steels more conventionally used in the past. However, martensitic stainless steels currently known for this purpose have the drawback of offering limited bending capacity. Therefore, they do not offer the possibility of satisfactorily absorbing the energy received by the vehicle upon an impact, while the requirements imposed by the regulations on this subject, and verified during crash tests, are difficult to fulfill.

This bending capacity of steel is usually assessed through three-point bending tests performed according to standard NF EN ISO 7438 and the VDA 238-100 plate bending test.

At the start of the test, the punch is brought into contact with the sheet metal which is supported by two rollers, with a pre-force of 30 N. Once contact is established, the displacement of the punch is indexed at zero. The test then consists in moving the punch so as to carry out the "three-point bending" of the sheet.

The test stops when micro-cracking of the sheet leads to a fall in the force on the punch of at least 30 N, or else when the punch has moved 14.2 mm, which corresponds to the maximum stroke allowed.

At the end of the test, the sheet metal sample is bent. The ductility in service may then be evaluated by measuring the bending angle $a_{10}$%, in degrees. The higher the angle $a_{10}$%, the better is the ability to crimp or bend the sheet.

SUMMARY OF THE INVENTION

The object of the invention is to propose a martensitic stainless steel having a composition and microstructure that make it well suited to the use mentioned above, in that it offers a good aptitude for V-bending as characterized in the aforementioned standard, and a high bending angle θ, as well as sufficiently high mechanical resistance properties Rm.

To this end, the invention relates to a martensitic stainless steel, characterized in that its composition is, in weight percentages:

0.05%≤C≤0.30%; preferably 0.05%≤C≤0.20%;
0.20%≤Mn≤2.0%;
traces %≤Si≤1.0%;
0.20%≤Mn+Si≤1.5%;
traces≤S≤0.01%, with 0≤10,000×Mn×S≤40;
traces≤P≤0.04%;

10.5%≤Cr≤17.0%, with $[Cr-10.3-80\times(C+N)^2]\leq(Mn+Ni)$;
traces≤Ni≤4.0%;
traces≤Mo≤2.0%; preferably traces≤Mo≤1.0%;
traces≤Mo+2≤W2.0%; preferably Mo+2W≤1.0%;
traces≤Cu≤2.0%;
traces≤Ti≤0.5%;
traces≤V≤0.3%;
traces≤Zr≤0.5%;
traces≤Al≤0.2%;
traces≤O≤400 ppm;
traces≤Ta≤0.3%;
traces≤Nb≤0.3%;
0.25≤(Nb+Ta)/(C+N)≤8;
Nb≥[1.2(C+N)−0.1]%;
0.009%≤N≤0.2%;
traces≤Co≤2.0%;
traces≤Cu+Co≤2.0%;
traces≤Cu+Co+Ni≤4.0%;
traces≤B≤0.1%;
traces≤H≤0.0005%; preferably traces≤H≤0.0001%, better traces≤H≤0.00001%
traces≤rare earths+Y≤0.06%;
traces≤Ca≤20 ppm;
the remainder being iron and impurities resulting from the processing;

and in that its microstructure comprises at least 75% martensite, at most 20% ferrite and at most 0.5% carbides, the size of the ferrite grains being between 4 and 80 μm, preferably between 5 and 40 μm.

According to a variant of the invention, traces≤Cu≤0.5%.

According to a variant of the invention, traces≤Co≤0.5%.

The invention also relates to a process for the preparation of a martensitic stainless steel product, characterized in that:

a martensitic stainless steel of the above-mentioned composition is produced, poured and transformed hot and/or cold;

an austenitization of said hot and/or cold transformed steel is performed by bringing it to a temperature between Ac1 and 1100° C. for 10 s to 1 hour, preferably 2 min to 10 min for reheating in a conventional oven, and 30 s to 1 min for an induction furnace, with a reheating speed of at least 5° C./s, the duration of the austenitization being adjusted to obtain, in all the steel, an austenitic microstructure containing at most 0.5% carbides by volume fraction and at most 20% residual ferrite by volume fraction;

and then a quenching of said austenitized steel from its austenitization temperature is performed to a temperature below its temperature Ms at which the martensitic transformation starts, at a cooling rate between 0.5 and 1000° C./s.

Said steel may be transformed into a hot and/or cold rolled sheet.

Said hot and/or cold rolled sheet may have a thickness of 0.5 to 12 mm, preferably 0.5 to 4 mm.

Preferably, during austenitization, the steel transformed hot and/or cold may be brought to a temperature between Ac1+100° C. and 1050° C. for 10 s to 1 h.

According to a variant of the invention, an additional heat treatment may be performed on the austenitized and then quenched steel at a temperature of 90 to 250° C. for 10 s to 1 h.

As will be understood, the invention is based on the coupling between a steel composition and a particular microstructure. This coupling makes it possible, in particular, to prepare sheets capable of being easily shaped by hot drawing, and to offer a very good compromise between a high tensile strength Rm, and a significant ability to bend in the final martensitic state, resulting in a bending angle θ that is equally high, as measured according to standard NF EN ISO 7438 and the VDA 238-100 procedure. Therefore, these sheets are particularly well suited for use as parts of automobile bodies offering a high capacity for absorbing energy resulting from shocks undergone by the vehicle.

The measurement of the product "Rm×θ/180", Rm being expressed in MPa and in degrees, and which should be as high as possible, is a good indicator of the ability of the steel to achieve such a compromise.

In fact, it is known that the energy absorbed by a tubular structure in bending or in compression is proportional to the mechanical resistance of the material comprising it, to the angles of bending of the different zones that are deformed, as well as to a geometric factor of the section: thickness, width, height. We may refer to the articles by D. Kecman Int. J. Mech. Sci, Vol. 25, No. 9-10, pp 623-636, 1983, or by T. Wierzbicki, Computers & Structures, Vol. 51, No. 6, pp 625-641, 1994 published by Elsevier.

The invention will be better understood in the light of the description that follows.

DESCRIPTION OF THE PREFERRED EMBODIMENTS

The minimum C content of 0.05% is justified by the need to obtain austenitization of the microstructure during the first step of the manufacturing process, thus before quenching. This will govern the mechanical properties of the sheet, in particular its ability to be shaped and its mechanical strength. A content of more than 0.30% is not desirable so as to avoid weakening the rough martensite formed by quenching (which would decrease the bending ability), and would degrade weldability, which would be a disadvantage for the preferred application of the invention in the automobile industry. However, a maximum content of 0.20% is preferred, so as to better ensure that a completely satisfactory bending angle is obtained when other conditions required by the invention regarding the composition of the steel and/or the thermal treatment are close to the set limits.

The minimum Mn content of 0.20% provides the necessary austenitization. Above 2.0%, oxidation problems are to be feared during heat treatments if these are not performed in neutral or reducing atmospheres. The mandatory use of neutral atmospheres may entail a high cost for the performance of heat treatments. Furthermore, manganese in an amount greater than 2.0% is unfavorable for obtaining the desired martensitic structure because of the possible presence of residual austenite at the end of the quenching.

Its Si content lies between traces and 1.0%. Silicon may be used as a deoxidizer during processing, exactly like Al, to which it may be added, or for which it may be substituted. However, above 1.0%, it is considered that it will excessively promote the formation of ferrite and, therefore, make austenitization more difficult, and that it will weaken the sheet too much to surely allow a shaping of a complex part that will perform satisfactorily.

Furthermore, the total content of Mn and Si must not exceed 1.5%. As Mn and Si are both segregating elements, too great a total presence of Mn and Si could adversely affect the homogeneity of the martensitic microstructure, in particular if the thickness of the part is relatively significant. The minimum content of Mn+Si is 0.2%, since Mn must be present at a content of at least 0.2%, as described earlier.

Its S content lies between traces and 0.01% in order to guarantee suitable weldability and resilience of the final product. However, beyond this, corrosion resistance will degrade and the bending angle reduced (in particular due to the precipitates of MnS), while, in order to avoid having excessive precipitation of MnS, it is important according to the invention to achieve the relationship given below where the contents of Mn and S are expressed in % by weight. (if Mn and S are each present in the form of simple impurities, in other words traces resulting from the processing, their contents are considered to be equal to 0 for this relationship):

$$0 \leq 10{,}000 \times Mn \times S \leq 40$$

Its P content lies between traces and 0.04%, in order to guarantee that the final product will not be excessively brittle. P is also detrimental to weldability and increases the brittleness of ferrite and martensite at grain boundaries.

Its Cr content lies between 10.5 and 17.0%. The minimum content of 10.5% is justified to ensure the oxidability of the sheet. A content higher than 17% would make austenitization difficult and unnecessarily increase the cost of steel.

Its Ni content lies between traces and 4.0%.

The presence of Ni within the prescribed limit of 4.0% maximum is advantageous for promoting austenitization. It is necessary to simultaneously respect the condition $[Cr-10.3-80*(C+N)^2] \leq (Mn+Ni)$, in other words $(Mn+Ni)-[Cr-10.3-80*(C+N)^2] \geq 0$, where the various contents are in % by weight.

Exceeding the 4.0% limit and/or not respecting the previous equation linking Cr, C, N, Mn and Ni would, however, lead to an excessive presence of residual austenite and an insufficient presence of martensite in the microstructure after cooling. Ni is also an expensive element, and its quantity should, as far as possible, be limited to what is strictly necessary to obtain the desired properties.

Its Mo content lies between traces and 2.0%, preferably 1.0%.

The presence of Mo is not essential. However, Mo favors good corrosion resistance. Austenitization would be hindered above 2.0% and the cost of the steel unnecessarily increased. A maximum content of 1.0% is preferred, because Mo is an embrittling element in that it limits the diffusion of hydrogen, which, so, is more difficult to remove from the metal.

Its W content is defined as a function of that of Mo by respecting the relationship traces≤Mo+2W≤2.0%, preferably traces≤Mo+2W≤1.0%. The advantages and disadvantages of W are qualitatively comparable to those of Mo.

Its Cu content lies between traces and a maximum of 2.0%, with a preference for a content≤0.5% if the steel is intended for the manufacture of a part that must be welded.

These Cu requirements are classic for this type of steel. In practice, this means that adding Cu is not useful and that the presence of this element is only due to the raw materials used. A content greater than 0.5%, which would generally correspond to a voluntary addition of Cu, is very often not desired, since it would degrade the weldability. Cu may, however, aid in austenitization, and a content of up to 2.0% may be accepted if the final part is not intended to be welded. This content of 2.0% should not be exceeded to avoid the risk of there being too much residual austenite in the steel.

For the same reason and the possible excessive presence of residual austenite, the sum Cu+Co must not exceed 2.0%, while the sum Cu+Co+Ni must not exceed 4.0%.

Its Ti content lies between traces and 0.5%.

Ti is a deoxidizer like Al and Si, but its cost and its lower efficiency than that of Al for deoxidation for an equal added quantity, makes its use generally not very interesting from this point of view. Ti may, however, have an advantage in that the formation of nitrides and carbonitrides of Ti can limit the growth of the grains and favorably influence certain mechanical properties and weldability. However, this formation may be a drawback in the case of the method according to the invention, since Ti tends to interfere with austenitization due to the formation of carbides, while TiN degrades the resilience and bending capacity. A maximum content of 0.5% should therefore not be exceeded.

Its V content lies between traces and 0.3%.

Its Zr content lies between traces and 0.5%.

Like Ti, V and Zr are embrittling elements which are capable of forming nitrides, and must not be present in too large a quantity, alone or in combination. On this last point, the following limit should be satisfied:

traces≤Ti+V+Zr≤0.5%

Its Al content lies between traces and 0.2%.

Al is usually used as a deoxidizer during processing. After deoxidation, there should not remain an amount exceeding 0.2% in the steel, because there would be a risk of a resulting excessive amount of AlN degrading the mechanical properties, as well as presenting difficulties in obtaining the predominantly martensitic microstructure because Al is highly ferritizing.

Its O content lies between traces and 400 ppm.

The requirements for the O content are classic for martensitic stainless steels, insofar as it relates to the ability to shape them without cracks starting from the inclusions, the quality of the mechanical properties or of bending required on the final part; the excessive presence of oxidized inclusions is likely to alter these properties.

A maximum Ca content of 20 ppm is tolerated. The addition of this element is not justified for reasons which are linked to the final properties of the steel. But it may be present following the processing of the liquid steel if it has been used, as is normal, for the deoxidation of molten steel, the control of the composition and of the morphology of the oxidized inclusions.

The final content of O is essentially determined by the addition of deoxidizers Al, Si, Ti, Zr during the processing, the possible addition of Ca, the care then taken in decanting the oxidized inclusions within the liquid steel, and the subsistence of these deoxidizers in the dissolved state in the solidified steel. While each of these elements, taken individually, may be absent or only very slightly present, it is nevertheless necessary that at least one of them (most often Al and/or Si) is present in an amount sufficient to guarantee that the O content of the final sheet will not be too high for uneventful shaping of the part, and for future applications of the part whose mechanical properties will be degraded by an excessive presence of oxide inclusions. These approaches governing the deoxidation of steels and the control of the composition and of the quantity of their oxidized inclusions, are well known to those skilled in the art, and are applied in the context of the invention in a perfectly conventional manner.

Its Nb content lies between traces and 0.3%, as does its Ta content. Ta being an element very close to Nb with regard to its metallurgical effects, in particular the formation of carbonitrides, the relationship 0.25≤(Nb+Ta)/(C+N)≤8 is to be satisfied.

Nb and Ta are important elements for obtaining good resilience and good bending ability, and at least one of them must be significantly present. But as they may interfere with austenitization, they should not be present in amounts exceeding what has just been prescribed. In addition, these elements capture C and N, and their total content must be adjusted according to the C and N contents actually present in the steel. If there is too little Nb and/or Ta in the steel when the C and N contents are relatively high, then there will not be enough dissolved Nb and Ta left for these elements to sufficiently improve the resilience.

0.25≤(Nb+Ta)/(C+N)≤8 is therefore required to obtain a resilience at 20° C. of the order of 50 J/cm$^2$ or more.

Its Co content lies between traces and 0.5%. This element, like Cu, can help austenitization. But it must not be added in an excessive amount in order to avoid deteriorating the weldability if the steel is intended to be transformed into a part to be welded. Otherwise, a Co content of 2.0% maximum is acceptable, provided, as has been said, a total Cu+Co content of 2.0% and a total content of Cu+Co+Ni of 4.0% is not exceeded, so as to avoid ending up with too high a residual austenite content.

Its Sn content lies between traces and 0.05%. This element is not desired because it is detrimental to weldability and the ability of the steel to be hot processed. The 0.05% limit is a tolerance that, in practice, will most often correspond to the absence of a voluntary addition.

Its B content lies between traces and 0.1%.

B is not mandatory, but its presence is advantageous for the hardenability and the forgeability of austenite. It therefore facilitates hot shaping. Its addition above 0.1% does not, however, provide any significant additional improvement on this point, while it increases the risk of precipitation in the form of boron nitrides, which would be unfavorable for shaping.

Its H content lies between traces and 5 ppm (0.0005%), preferably not more than 1 ppm (0.0001%) and, better still, not more than 0.1 ppm (0.00001%).

Excessive H content tends to make martensite and ferrite more brittle. It will therefore be necessary to choose a method for the production of steel in the liquid state that can ensure this low presence of H. Typically, treatments ensuring a thorough degassing of the liquid steel (by massive injection of argon in the liquid steel under atmospheric pressure, which is a well-known process known as AOD—Argon Oxygen Decarburization-, or by vacuum treatment) are recommended.

Its N content lies between traces and 0.2%.

N is an impurity, the same treatments making it possible to reduce the H content contribute to limiting its presence or even reducing it substantially. It is not always necessary to have a particularly low N content, but it must be ensured that its content, when considered in conjunction with the contents of elements with which it may combine to form nitrides or carbonitrides, is not too high. This results in the relation 0.25≤(Nb+Ta)/(C+N)≤8 seen above, the respect of which contributes to providing sufficient resilience.

Its total rare earth and Y content lies between traces and 0.06%.

Rare earths and Y improve the properties of resistance to oxidation (lower oxidation kinetics, therefore less oxide formed), which may be an advantage during hot shaping. On the other hand, if they are present in large quantities, the non-metallic inclusions which they form, cause serious problems during casting, or, further downstream, during pickling, due to the high reactivity of the rare earths and of Y. The possible total addition of rare earths and of Y is limited to 0.06%. In any event, the high price of these elements makes it generally preferable to have recourse to more common elements, such as Al or Si, to ensure deoxidation.

It should be understood that the sheets prepared according to the invention may be coated sheets, wherein the coating (generally with Zn, or Al, or alloys, one and/or the other of which are among the main components) may take place before or after the sheet is shaped. The coating techniques that may be used do not differ from those usually practiced on steels (immersion in a molten bath of Al, or Zn, or one of their alloys, electroplating, CVD/PVD). This coating, typically 1 to 200 μm thick and present on one or two faces of the sheet, may have been deposited by any technique conventionally used for this purpose. It is simply necessary that, if it is deposited before the austenitization, it does not evaporate during the presence of the sheet at the austenitization temperatures, which may sometimes happen even if this presence is short.

The choice and optimization of the characteristics of the coating and of its method of deposition to meet these conditions, do not go beyond what those skilled in the art do when they shape conventionally coated stainless steel sheets. If the coating takes place before austenitization, it may, however, be preferable to have coatings based on Al over those based on Zn, as Al is less likely than Zn to evaporate at austenitization temperatures.

The steel having the composition according to the invention is produced, cast and hot processed in a conventional manner, for example by being shaped into hot and/or cold rolled sheets in a thickness typically ranging from 0.5 mm at 12 mm. However, in the preferred application of the invention to sheets for automobiles, the preferred thickness is in the range 0.5 to 4 mm.

Then, according to the invention, the transformed product thus obtained first undergoes austenitization, which brings it into a range of temperatures between the temperature Ac1 of the appearance of austenite during heating and 1100° C., ideally between Ac1+100° C. and 1050° C., for a period varying from 10 s to 1 h, so as to both guarantee complete austenitization and limit product oxidation as well as the energy cost of austenitization. It should be understood that this austenitization temperature must relate to the entire volume of the sheet, and that the treatment must be sufficiently long so that, taking into account the thickness of the sheet and the kinetics of the transformation, the austenitization is completed throughout this volume. This is, of course, valid for a semi-finished product other than a sheet.

The furnace where the austenitization takes place may be a conventional furnace or an induction furnace which allows rapid and uniform heating, but the reheating rates must be greater than 5° C./s to avoid coalescence of the carbide precipitates already present, and which would slow their dissolution during austenitization. The intention not to impose too long a total duration at the austenitization stage is also responsible for this minimum heating speed. The atmosphere is, in the standard case, air, and the time and the temperature conditions are optimized to limit oxidation while guaranteeing complete austenitization.

It is, however, preferable to avoid performing this austenitization in an oxidizing atmosphere such as air, so as to more definitively avoid significant oxidation and/or surface decarburization of the sheet in the heating atmosphere. Surface oxidation would lead to the need to descale the sheet mechanically or chemically before it is shaped to avoid scaling on the surface of the sheet, and would cause a loss of material and a degradation in the final appearance of the surface of the shaped part. Excessive decarburization in the skin to a depth of a few tens of μm would reduce the hardness and the tensile strength of the sheet. The risks of significant oxidation and/or decarburization depend, in a known manner, not only on the austenitization temperature, but also on the treatment atmosphere of the furnace. A non-oxidizing, therefore neutral or reducing atmosphere (nitrogen, argon, CO, hydrogen and their mixtures), preferably in air, makes it possible to increase the treatment temperature without damage, which makes it possible to ensure complete austenitization in a minimum time. If a hydrogenated atmosphere is used, it must be ensured that it does not lead to the uptake of hydrogen by the metal, which would cause it to exceed the limits prescribed above.

Typically, the austenitization takes place at a temperature between 925° C. and 1000° C. for a period of 10 s to 1 h (this duration being that allowing the sheet to pass above Ac1), preferably between 2 min and 10 min for heating in a conventional oven, and between 30 s and 1 min for an induction oven. An induction oven has the advantage, known per se, of providing rapid reheating to the nominal austenitization temperature. In addition, it immediately involves the entire volume of the sheet, and therefore allows a shorter treatment than a conventional oven to achieve the desired result. These temperatures and durations make it possible to ensure that the continuation of the treatments will lead to a sufficient formation of martensite during a reasonable time allowing good productivity of the process.

The purpose of this austenitization is to pass all of the metal from the initial ferrite+carbide microstructure to an austenitic microstructure containing at most 0.5% carbides by volume fraction, and at most 20% residual ferrite by volume fraction. One aim of this austenitization is, in particular, to lead to the dissolution of at least the majority of the carbides initially present, so as to release C atoms to form the martensitic structure during the following stages of the process. The maximum residual ferrite content of 20%, which must remain until the final product is completed, is justified by the resilience and the conventional yield strength that it is desired to obtain. The duration of the austenitization is adjusted so that this microstructure is obtained throughout the treated steel, and may therefore vary according to the precise dimensions of the semi-finished product at this stage. Those skilled in the art may easily carry out this adjustment by modeling and/or experiments conducted on the installation at their disposal, for a semi-finished product of given shape and dimensions.

The temperature Ac1 depends on the chemical composition, and also on the heating rate. It is measured, as is known, by following the expansion of a sample during heating performed at a predefined heating rate situated between 10 and 100° C./s. Ac1 is the first temperature at which the slope of the curve "temperature=f(time)" cancels out, and therefore corresponds to the appearance of the austenitic phase. It should be understood that in the invention, the temperature Ac1 is that which is obtained experimentally on the semi-finished product having the required composition, but Ac1 is a quantity that does not depend on the size of the semi-finished product, but essentially only on its composition.

Then after this austenitization, according to the invention, the semi-finished products are quenched from the austenitization temperature, either in the open air, still or pulsed, or by immersing them in a tank of water or oil at room temperature, or in the shaping tools in the case of the use of a hot shaping process such as hot drawing. The objective is to obtain, throughout the volume of the semi-finished product, a cooling rate of between 0.5 and 1000° C./s to a temperature below the temperature Ms at the start of the martensitic transformation, which is typically around 300° C., then cooling between 0.5 and 20° C./s to room temperature. Ms depends on the composition of the steel and may be determined, in a conventional manner, by formulas and models or dilatometric tests. See, for example, the document "F. B. Pickering, Physical Metallurgical Development of Stainless Steels", Stainless Steels '84, pp 2-28, The Institute of Metals, London, 1985. Cooling down to room temperature is the most usual approach, while a particular control of the speed of cooling below Ms is not necessary.

A final product is thus obtained, for example, in the form of a sheet that is intended to be used in a structure designed to best absorb energy resulting from a crash while resisting impact rupture, and which typically has the following properties at ambient temperature:

Tensile strength Rm: at least 900 MPa;

Conventional yield strength $Rp_{0.2}$: at least 700 MPa;

Elongation at break A: at least 5%, measured according to the ISO 6892 standard;

Preferred resilience if possible: for conditions where the ratio of martensite is greater than 75%, at least 50 J/cm$^2$ at 20° C.;

Bending angle capacity, measured on a 1.5 mm thick sample according to VDA 238-100: at least 50°;

Absorption capacity in the crash test measured by the relationship (Rm×bending)angle/180°) greater than 450, wherein Rm is expressed in MPa and the bending angle in degrees, measured according to standard VDA 238-100 on a 1.5 mm thick sample.

These properties are obtained thanks to the combination of the composition of the aforementioned steel and a suitable microstructure of this steel as obtained thanks to the austenitization-quenching treatment described, which is at least 75% martensitic, and contains, at most, 20% ferrite, the grain size of which is from 1 to 80 μm, preferably between 5 and 40 μm, and a volume fraction of carbides of, at most, 0.5%. The residual austenite fraction which may be tolerated after quenching is, therefore, at most, approximately 5%, corresponding substantially to the difference between 100% and the sum of the fractions of martensite, ferrite and carbides.

Equally, an additional heat treatment may be performed on the final part, therefore after cooling to ambient temperature, so as to improve its elongation at break and bring it to a value of more than 10% but without reducing the mechanical characteristics and the bending capacity. This treatment consists in ensuring the final part remains between 90° C. and 250° C. for 10 s to 1 h. This additional treatment may also be subjected to hardening by bake hardening, the temperatures and durations of which are in this range, typically 180° C. and 20 min. These treatments and the subsequent cooling are performed in still air, therefore at a cooling rate of the order of a few ° C./s.

Table 1 below shows compositions of steels to which have been applied, after preparation and hot rolling performed under similar and conventional conditions, followed by annealing the hot rolled product in an oven under an inert atmosphere of hydrogen at 800° C. for 5 hours, then cold rolling up to 1.5 mm:

either, the following reference treatment: annealing at 800° C. for 15 min, without quenching, followed by pickling, or, the following heat treatment according to the invention: increase to 950° C. at a heating rate of 20° C./s, austenitization at 950° C. for 5 min, quenching to 300° C. at a cooling rate of 10° C./s using forced air; this treatment may or may not be preceded by the reference treatment and a pickling.

The contents are given in % by weight. Elements not mentioned are only present at the level of traces resulting from the processing.

TABLE 1

Compositions of test samples

| | | Steels | | | | | | | | | | |
|---|---|---|---|---|---|---|---|---|---|---|---|---|
| | | C | N | Cr | Mn | Ni | Cu | Si | S | P | Nb | B |
| Compositions according to the invention | 1 | 0.022 | 0.015 | 11.5 | 0.60 | 0.5 | 0.1 | 0.56 | 0.002 | 0.020 | 0.050 | 0.001 |
| | 2 | 0.05 | 0.035 | 11.0 | 0.50 | 0.4 | 0.1 | 0.36 | 0.001 | 0.034 | 0.052 | 0.001 |
| | 3 | 0.06 | 0.017 | 11.4 | 0.40 | 0.3 | 0.1 | 0.31 | 0.001 | 0.023 | 0.099 | 0.001 |
| | 4 | 0.07 | 0.010 | 11.2 | 0.50 | 0.4 | 0.05 | 0.36 | 0.006 | 0.022 | 0.104 | 0.001 |
| | 5 | 0.10 | 0.030 | 12.0 | 0.35 | 0.10 | 0.04 | 0.40 | 0.006 | 0.022 | 0.106 | 0.001 |
| | 6 | 0.24 | 0.080 | 11.1 | 0.30 | 0.16 | 0.05 | 0.42 | 0.008 | 0.016 | 0.15 | 0.003 |
| | 7 | 0.06 | 0.010 | 11.1 | 0.50 | 0.40 | 0.3 | 0.35 | 0.0015 | 0.0016 | 0.10 | 0.001 |
| | 8 | 0.14 | 0.050 | 11.1 | 0.45 | 0.40 | 0.3 | 0.35 | 0.005 | 0.025 | 0.14 | 0.001 |
| Reference compositions | 9 | 0.22 | 0.001 | 0.2 | 1.20 | 0.02 | 0.001 | 0.25 | 0.004 | 0.019 | 0.001 | 0.003 |
| | 10 | 0.10 | 0.001 | 0.3 | 1.30 | 0.02 | 0.001 | 0.50 | 0.006 | 0.010 | 0.01 | 0.001 |
| | 11 | 0.12 | 0.002 | 1.0 | 2.10 | 0.03 | 0.001 | 0.75 | 0.002 | 0.016 | 0.01 | 0.005 |
| | 12 | 0.25 | 0.001 | 0.05 | 1.40 | 0.02 | 0.001 | 0.40 | 0.005 | 0.008 | 0.01 | 0.005 |
| | 13 | 0.37 | 0.004 | 0.2 | 1.40 | 0.04 | 0.001 | 0.70 | 0.005 | 0.0015 | 0.05 | 0.005 |
| | 14 | 0.048 | 0.015 | 14.3 | 0.90 | 1.5 | 0.2 | 0.35 | 0.005 | 0.025 | 0.01 | 0.001 |
| | 15 | 0.009 | 0.010 | 12.0 | 0.22 | 0.10 | 0.3 | 0.40 | 0.001 | 0.030 | 0.001 | 0.001 |

| | | Steels | | | | | | | | | | |
|---|---|---|---|---|---|---|---|---|---|---|---|---|
| | | Mo | W | Ti | V | Al | O | Co | Zr | H | Ca | Ta |
| Compositions according to the invention | 1 | 0.10 | 0.001 | 0.005 | 0.10 | 0.002 | 0.001 | 0.05 | 0.001 | 0.00002 | 0.0005 | 0.02 |
| | 2 | 0.10 | 0.001 | 0.005 | traces | 0.002 | 0.001 | 0.05 | 0.005 | 0.00002 | 0.0005 | 0.001 |
| | 3 | 0.20 | 0.001 | 0.077 | traces | 0.002 | 0.001 | 0.05 | 0.001 | 0.00002 | 0.0005 | 0.001 |
| | 4 | 0.15 | 0.005 | 0.004 | 0.10 | 0.002 | 0.001 | 0.05 | 0.001 | 0.00002 | 0.0005 | 0.001 |
| | 5 | 0.16 | 0.005 | 0.006 | 0.10 | 0.002 | 0.001 | 0.02 | 0.001 | 0.00002 | 0.0005 | 0.001 |
| | 6 | 0.20 | 0.005 | 0.005 | 0.08 | 0.002 | 0.001 | 0.001 | 0.001 | 0.00002 | 0.0005 | 0.001 |
| | 7 | 0.25 | 0.002 | 0.01 | 0.03 | 0.002 | 0.001 | 0.001 | 0.001 | 0.00002 | 0.0005 | 0.001 |
| | 8 | 0.20 | 0.005 | 0.004 | 0.07 | 0.002 | 0.001 | 0.02 | 0.002 | 0.00002 | 0.0005 | 0.001 |
| Reference compositions | 9 | 0.01 | 0.001 | 0.01 | 0.004 | 0.003 | 0.001 | 0.03 | 0.002 | 0.00002 | 0.0005 | 0.001 |
| | 10 | 0.05 | 0.001 | 0.01 | 0.05 | 0.001 | 0.001 | 0.001 | 0.001 | 0.00002 | 0.0005 | 0.001 |
| | 11 | 0.01 | 0.001 | 0.07 | 0.04 | 0.001 | 0.001 | 0.001 | 0.001 | 0.00002 | 0.0005 | 0.001 |

TABLE 1-continued

| Compositions of test samples | | | | | | | | | | | |
|---|---|---|---|---|---|---|---|---|---|---|---|
| 12 | 0.02 | 0.001 | 0.05 | 0.06 | 0.001 | 0.001 | 0.001 | 0.001 | 0.00002 | 0.0005 | 0.001 |
| 13 | 0.015 | 0.001 | 0.004 | 0.05 | 0.001 | 0.001 | 0.001 | 0.001 | 0.00002 | 0.0005 | 0.001 |
| 14 | 0.29 | 0.001 | 0.04 | 0.05 | 0.001 | 0.001 | 0.02 | 0.001 | 0.00002 | 0.0005 | 0.02 |
| 15 | 0.30 | 0.001 | 0.20 | 0.02 | 0.001 | 0.001 | 0.02 | 0.001 | 0.00002 | 0.0005 | 0.001 |

Table 2 shows, for the steels of Table 1, how they meet or not the relationships required by the invention. Values not according to the invention are underlined.

TABLE 2

Relationships between different elements according to the invention, for the samples tested

| | | Steels | | | | | |
|---|---|---|---|---|---|---|---|
| | | W + 2Mo ≤ 2% | 0.25 ≤ (Nb + Ta)/(C + N) ≤ 8 | 0.2% ≤ Mn + Si ≤ 1.5% | Mn*S*10000 ≤ 40 | (Mn + Ni) − [Cr − 10.3 − 80*(C + N)$^2$] ≥ 0 | Ti + Zr + V ≤ 0.5% |
| according to the | 1 | 0.201 | 1.89 | 1.16 | 12 | 0.01 | 0.106 |
| | 2 | 0.201 | 0.62 | 0.86 | 5 | 0.78 | 0.010 |
| | 3 | 0.401 | 1.30 | 0.71 | 4 | 0.07 | 0.078 |
| | 4 | 0.305 | 1.31 | 0.86 | 30 | 0.52 | 0.105 |
| | 5 | 0.325 | 0.82 | 0.75 | 21 | 0.10 | 0.107 |
| | 6 | 0.405 | 0.47 | 0.72 | 24 | 7.85 | 0.086 |
| | 7 | 0.502 | 1.44 | 0.85 | 7.5 | 0.49 | 0.041 |
| | 8 | 0.405 | 0.74 | 0.80 | 22.5 | 2.94 | 0.076 |
| Reference compositions | 9 | 0.021 | 0.01 | 1.48 | 49.2 | 15.26 | 0.016 |
| | 10 | 0.101 | 0.11 | 1.8 | 78 | 12.14 | 0.061 |
| | 11 | 0.021 | 0.09 | 2.85 | 42 | 12.62 | 0.111 |
| | 12 | 0.041 | 0.04 | 1.80 | 70 | 16.71 | 0.111 |
| | 13 | 0.031 | 0.14 | 2.10 | 70 | 22.73 | 0.055 |
| | 14 | 0.581 | 0.48 | 1.25 | 45 | −1.23 | 0.091 |
| | 15 | 0.601 | 0.11 | 0.62 | 2.2 | −1.35 | 0.221 |

Table 3 shows the metallurgical structures obtained after the heat treatments performed on the various steels of Table 1. The underlined values are those that mean that the examples concerned are not considered to be in accordance with the invention, from the point of view of their microstructure.

TABLE 3

Microstructural characteristics of the steels in Table 1 after heat treatments

| | | Steels | | | | |
|---|---|---|---|---|---|---|
| | | Heat treatment | Carbides (%) | Ferrite (%) | Size of ferrite grain (μm) | Martensite (%) |
| Compositions according to the invention | 1 | 950° C. 5 min | 0.001 | 15 | 30 | 84.999 |
| | 2 | 950° C. 5 min | 0.001 | 17 | 25 | 82.999 |
| | 3 | 950° C. 5 min | 0.005 | 1 | 10 | 98.995 |
| | 4 | 950° C. 5 min | 0.005 | 2 | 5 | 97.995 |
| | 5 | 950° C. 5 min | 0.005 | 1 | 10 | 98.995 |
| | 6 | 950° C. 5 min | 0.005 | 3 | 10 | 96.995 |
| | 7 | 950° C. 5 min | 0.005 | 2 | 5 | 97.995 |
| | 8 | 950° C. 5 min | 0.005 | 0 | — | 99.995 |
| | 1 | Reference (not invention) | 0.01 | 99.99 | 35 | 0.000 |
| | 1 | 950° C. 2 h (not invention) | 0.001 | 13 | 130 | 86.999 |
| | 3 | Reference (not invention) | 0.01 | 99.99 | 60 | 0.000 |
| | 8 | Reference (not invention) | 0.02 | 99.98 | 30 | 0.000 |

TABLE 3-continued

Microstructural characteristics of the steels in Table 1 after heat treatments

| | | Steels | | | | |
|---|---|---|---|---|---|---|
| | | Heat treatment | Carbides (%) | Ferrite (%) | Size of ferrite grain (μm) | Martensite (%) |
| Reference compoditions | 9 | 950° C. 5 min | 0.005 | 1 | 25 | 98.995 |
| | 9 | Reference (not invention) | 0.01 | 99.99 | 20 | 0.000 |
| | 10 | Reference (not invention) | 0.01 | 99.99 | 30 | 0.000 |
| | 11 | 950° C. 5 min | 0.02 | 10 | 50 | 89.980 |
| | 12 | 950° C. min | 0.01 | 2 | 45 | 97.990 |
| | 13 | 950° C. 5 min | 0.01 | 0 | — | 99.990 |
| | 14 | 950° C. 5 min | 0.01 | 45 | 30 | 54.990 |
| | 15 | 950° C. 5 min | 0.01 | 95 | 25 | 4.990 |

Table 4 shows the properties of the examples according to the invention, and those of the reference examples which do not satisfy all the relationships and do not achieve all the properties which the invention aims to obtain. The underlined values are those which are not satisfactory with regard to the criteria mentioned above. Resilience tests were not performed on steels which had an insufficient martensite content which, in any case, placed them outside the invention.

TABLE 4

Mechanical and bending properties of the tested samples

| | | Steels | | | | | | |
|---|---|---|---|---|---|---|---|---|
| | | Heat treatment | $Rp_{0.2}$ (MPa) | Rm (MPa) | A(%) | Bending angle (°) | Rm*angle/180° | Resilience (J/cm$^2$) at 20° C. for martensitic grade > 75% in volume |
| Compositions according to the invention | 1 | 950° C. 5 min | 720 | 910 | 6 | 135 | 683 | 90 |
| | 2 | 950° C. 5 min | 760 | 1030 | 10 | 115 | 658 | 55 |
| | 3 | 950° C. 5 min | 750 | 990 | 8 | 110 | 605 | 65 |
| | 4 | 950° C. 5 min | 870 | 1130 | 9 | 100 | 628 | 70 |
| | 5 | 950° C. 5 min | 850 | 1170 | 8 | 85 | 553 | 60 |
| | 6 | 950° C. 5 min | 1200 | 1800 | 7 | 50 | 500 | 55 |
| | 7 | 950° C. 5 min | 900 | 1100 | 9 | 95 | 581 | 70 |
| | 8 | 950° C. 5 min | 1200 | 1500 | 5 | 55 | 458 | 55 |
| | 1 | Reference | 390 | 475 | 26 | 135 | 356 | NA |
| | 1 | 950° C. 2 h (not invention) | 720 | 790 | 4 | 80 | 351 | 70 |
| | 3 | Reference (not invention) | 285 | 505 | 30 | 125 | 351 | NA |
| | 8 | Reference (not invention) | 290 | 520 | 25 | 120 | 347 | NA |
| Reference compositions | 9 | 950° C. 5 min | 1050 | 1500 | 5 | 50 | 417 | 50 |
| | 9 | Reference (not invention) | 350 | 500 | 15 | 120 | 333 | NA |
| | 10 | Reference (not invention) | 400 | 550 | 16 | 120 | 367 | NA |
| | 11 | 950° C. 5 min | 800 | 1000 | 6 | 75 | 417 | 45 |
| | 12 | 950° C. 5 min | 1100 | 1500 | 3 | 50 | 417 | 45 |
| | 13 | 950° C. 5 min | 1400 | 1760 | 3 | 45 | 440 | 40 |
| | 14 | 950° C. 5 min | 700 | 900 | 5 | 55 | 275 | NA |
| | 15 | 950° C. 5 min | 200 | 380 | 25 | 135 | 285 | NA |

The following remarks may be mainly deduced from these results.

The reference steels 9 to 13 are non-stainless martensitic steels (therefore not belonging to the class of steels of the invention and of the other reference steels 14 and 15) of a known type and commonly used in the automobile industry. They were tested with a view to showing how the properties of the steels of the invention compared to their properties.

The reference steels 9 to 12 have compositions in accordance with the invention on elements other than Cr taken alone. But they do not contain enough Nb+Ta compared to the sum C+N, not enough Mn+Si (except 9, and just barely), and too much Mn compared to S. Those steels that have undergone a heat treatment according to the invention at 950° C. for 5 min, are nevertheless found with a suitable microstructure. Their bending angles in the martensitic condition are correct, but at the same time their Rm is not high enough to provide them with an absorption capacity in the crash test that would correspond to expectations. As for those that have undergone the reference heat treatment, they are left with a ferritic microstructure: their bending angle is high (120°) but as the Rm is low due to the absence of martensite, the absorption capacity in the crash test is much lower than the target.

The reference steel 13 also has too high a C content. As may be expected, the bending angle is even less than that of other examples of non-stainless martensitic steels which have undergone the same heat treatment. During the crash test, its very high Rm does not compensate for this poor bending ability.

The reference steels 14 and 15 are martensitic stainless steels.

The reference steel 14 has a measured C content which is only very slightly lower than the minimum required by the invention, and which could be understood as being equal to this minimum. On the other hand, it does not respect the relationship linking Mn, Ni, Cr, C and N. After the heat treatment performed under conditions in accordance with the invention, it ends up with too high a ferrite content. Consequently, while its bending angle is correct, its Rm is not high enough, by far, to ensure sufficient absorption capacity in the crash test.

The reference steel 15 has a C content considerably lower than that required by the invention, which provides it with an almost entirely ferritic microstructure after the heat treatment. The virtual absence of Nb and Ta gives it a lower (Nb+Ta)/(C+N) ratio than is required by the invention. The relationship linking Mn, Ni, Cr, C and N is also not complied with, which contributes to the very ferritic nature of the microstructure. As a result, Rm and $Rp_{0.2}$ are very poor, and despite a very high bending angle, the absorption capacity in the crash test is insufficient.

The steel 1, the composition of which is in accordance with the invention, has undergone three different heat treatments.

The treatment at 950° C. for 5 min followed by quenching is in accordance with the invention. The result is a steel which meets the requirements of the invention in all respects. In particular, its bending angle of 135° is very high, and as its Rm is correct, its absorption capacity in the crash test is excellent.

The reference heat treatment applied to this steel 1 also made it possible to obtain this high bending angle. But Rm is quite insufficient (like $Rp_{0.2}$), and the shock absorption capacity is frankly insufficient.

The heat treatment at 950° C. for 2 hours followed by quenching applied to this steel is not satisfactory either. Its high duration led to an excessive increase in the size of the ferrite grains (130 μm against 30 μm for the treatment according to the invention, and 35 μm for the reference treatment, performed at a lower temperature but for a longer period than the treatment according to the invention). The consequence was that the steel had a smaller bending angle than with the treatment according to the invention, and, above all, an insufficient Rm and elongation at break A. The shock absorption capacity is therefore not in accordance with the requirements of the invention.

These test results on steel 1 show that it is indeed the coupling between the composition of the steel and the austenitization and quenching heat treatment under the precise conditions required, that is important for obtaining the desired results in terms shock absorption capacity and satisfactory mechanical properties.

The steel 3 according to the invention has also undergone different heat treatments, one according to the invention at 950° C. for 5 min, the other in accordance with the reference treatment. The treatment according to the invention made it possible to obtain on steel 3 properties that are satisfactory in all respects with regard to the objectives sought, with an almost entirely martensitic structure, that are linked to the weakest presence of Si than in steel 1, and a small size of ferrite grains. But as for steel 1, the reference heat treatment only led to mediocre $Rp_{0.2}$ and Rm properties, insufficient to ensure a good shock absorption capacity despite a high bending capacity.

The steel 8 according to the invention, which is relatively rich in C, Nb and V, also underwent the same two heat treatments as steel 3. With the treatment according to the invention, its structure is entirely martensitic. Its elongation at break and its bending angle are only just correct, but its high Rm gives it sufficient shock absorption capacity. If the reference heat treatment is applied to it, its structure is entirely ferritic. The high bending angle is not accompanied by a sufficient Rm for the shock absorption capacity to be adequate.

The steel 6 according to the invention is distinguished from the other examples by a C content of 0.24%, therefore even higher than that of steel 8. Its structure is almost exclusively martensitic after the application of the heat treatment according to the invention. Its bending angle is just sufficient due to the high C content which is not in the preferred range for the invention, but its very high Rm nevertheless gives it a good shock absorption capacity.

The invention claimed is:

1. Martensitic stainless steel, wherein its composition is, in weight percentages:

0.05%≤C≤0.30%;
0.20%≤Mn≤2.0%;
traces %≤Si≤1.0%;
0.20%≤Mn+Si≤1.5%;
traces≤S≤0.01%, with 0≤10,000×Mn×S≤40;
traces≤P≤0.04%;
10.5%≤Cr≤17.0%, with $[Cr-10.3-80\times(C+N)^2]\leq(Mn+Ni)$;
traces≤Ni≤4.0%;
traces≤Mo<2.0%;
traces≤Mo+2W<2.0%;
traces≤Cu≤2.0%;
traces≤Ti≤0.5%;
traces≤V≤0.3%;
traces≤Zr≤0.5%;
traces≤Al≤0.2%;
traces≤O≤400 ppm;
traces≤Ta≤0.3%;
traces≤Nb≤0.3%;
0.25≤(Nb+Ta)/(C+N)≤8;
Nb≥[1.2 (C+N)−0.1]%;
0.009%≤N≤0.2%;
traces≤Co≤2.0%;
traces≤Cu+Co≤2.0%;
traces≤Cu+Co+Ni≤4.0%;
traces≤B≤0.1%;
traces≤H≤0.0005%;
traces≤rare earths≤0.06%, rare earths including Y;
traces≤Ca≤20 ppm;
the remainder being iron and impurities resulting from the processing;
and its microstructure comprises at least 75% martensite, less than 20% ferrite and at least 0.0001% and at most 0.5% carbides, the size of the ferrite grains being between 4 and 80 μm.

2. The martensitic stainless steel according to claim 1, wherein traces≤Cu≤0.5%.

3. The martensitic stainless steel according to claim 1, wherein traces≤Co≤0.5%.

4. The martensitic stainless steel according to claim 1, wherein 0.05%≤C≤0.20%.

5. The martensitic stainless steel according to claim 1, wherein traces≤Mo≤1.0%.

6. The martensitic stainless steel according to claim 1, wherein Mo+2W≤1.0%.

7. The martensitic stainless steel according to claim 1, wherein traces≤H≤0.0001%.

8. The martensitic stainless steel according to claim 7, wherein traces≤H≤0.00001%.

9. The martensitic stainless steel according to claim 1, wherein the size of the ferrite grains is between 5 and 40 μm.

10. The martensitic stainless steel according to claim 1, wherein traces≤Mo≤1.0% and the composition comprises at most 0.005% W.

11. The martensitic stainless steel according to claim 1, wherein traces≤Mo≤0.3%.

12. The martensitic steel according to claim 1, wherein traces≤Mo≤0.25%.

13. The martensitic steel according to claim 1, wherein traces≤Mo+2W≤0.601%.

14. The martensitic steel according to claim 1, wherein traces≤Mo+2W≤0.502%.

15. The martensitic steel according to claim 1, wherein Rm x bending angle/180° is greater than 450, wherein:

Rm is a tensile strength of said martensitic steel expressed in MPa, and said bending angle is measured according to standard VDA 238-100 on a 1.5 mm thick sample sheet of said martensitic steel and is expressed in degrees.

16. Method for preparing the martensitic stainless steel of claim 1, comprising the steps of, producing a martensitic stainless steel with a composition according to claim 1, pouring and transforming to hot and/or cold;

performing an austenitization of said hot and/or cold transformed steel by bringing it to a temperature between Ac1 and 1100° C. for 10 s to 1 hour, for reheating in a conventional oven and 30 s to 1 min for an induction furnace, with a reheating speed of at least 5° C./s, the duration of the austenitization being adjusted to obtain, throughout the steel, an austenitic microstructure containing at most 0.5% carbides by volume fraction and at most 20% residual ferrite by volume fraction;

and performing a quenching of said austenitized steel from its austenitization temperature to a temperature below its Ms temperature at the start of the martensitic transformation, at a cooling rate of between 0.5 and 1000° C./s; thereby producing the martensitic stainless steel of claim 1.

17. The method according to claim 16, wherein said steel is transformed into a hot-rolled and/or cold-rolled sheet.

18. The method according to claim 17, wherein said hot-rolled and/or cold-rolled sheet has a thickness of 0.5 to 12 mm, preferably 0.5 to 4 mm.

19. The method according to claim 16, wherein during the austenitization, the hot and/or cold shaped steel is brought to a temperature between Ac1+100° C. and 1050° C. for 10 s to 1 hour.

20. The method according to claim 16, wherein an additional heat treatment is performed on the austenitized and quenched steel at a temperature of 90 to 250° C. for 10 s to 1 h.

21. The method according to claim 16, wherein austenitization of said hot and/or cold transformed steel is performed by bringing it to a temperature between Ac1 and 1100° C. for 2 min to 10 min in a conventional oven.

22. The method according to claim 17, wherein during the austenitization, the hot and/or cold shaped steel is brought to a temperature between Ac1+100° C. and 1050° C. for 10 s to 1 hour.

23. The method according to claim 18, wherein during the austenitization, the hot and/or cold shaped steel is brought to a temperature between Ac1+100° C. and 1050° C. for 10 s to 1 hour.

24. The method according to claim 17, wherein an additional heat treatment is performed on the austenitized and quenched steel at a temperature of 90 to 250° C. for 10 s to 1 h.

25. The method according to claim 18, wherein an additional heat treatment is performed on the austenitized and quenched steel at a temperature of 90 to 250° C. for 10 s to 1 h.

26. The method according to claim 19, wherein an additional heat treatment is performed on the austenitized and quenched steel at a temperature of 90 to 250° C. for 10 s to 1 h.

* * * * *